US008145079B2

(12) United States Patent
Naruse

(10) Patent No.: US 8,145,079 B2
(45) Date of Patent: Mar. 27, 2012

(54) IMAGE FORMING DEVICE HAVING AN ADJUSTING UNIT FOR ADJUSTING AN IMAGE FORMING POSTION ON A ROTATIONAL BODY

(75) Inventor: Kenichi Naruse, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 609 days.

(21) Appl. No.: 12/276,869

(22) Filed: Nov. 24, 2008

(65) Prior Publication Data

US 2009/0142080 A1 Jun. 4, 2009

(30) Foreign Application Priority Data

Nov. 29, 2007 (JP) ..... 2007-308568

(51) Int. Cl.
*G03G 15/00* (2006.01)

(52) U.S. Cl. ..... 399/36; 399/83

(58) Field of Classification Search ..... 399/24, 399/26, 36, 51, 66, 83
See application file for complete search history.

(56) References Cited

U.S. PATENT DOCUMENTS

| | | | | |
|---|---|---|---|---|
| 7,290,848 | B2 | 11/2007 | Masuda | |
| 7,471,905 | B2 * | 12/2008 | Cook | 399/24 |
| 2007/0109335 | A1 | 5/2007 | Masuda | |

FOREIGN PATENT DOCUMENTS

| | | |
|---|---|---|
| JP | 2000-112296 | 4/2000 |
| JP | 2000284561 | 10/2000 |
| JP | 2001-034113 | 2/2001 |
| JP | 2003144705 | 5/2003 |
| JP | 2005053118 | 3/2005 |

OTHER PUBLICATIONS

Notification of Reasons of Rejection for Japanese Application No. 2007-308568 mailed on Oct. 13, 2009.

* cited by examiner

*Primary Examiner* — David Gray
*Assistant Examiner* — Gregory H Curran
(74) *Attorney, Agent, or Firm* — Banner & Witcoff, Ltd.

(57) ABSTRACT

An image forming device includes a rotational body configured such that an image to be transferred onto a sheet is formed in an image forming position thereon, a storage configured to store thereon, in a non-volatile manner, a correction parameter for canceling a deviation of the image forming position caused due to unevenness of a rotational speed of the rotational body, an adjusting unit configured to adjust the image forming position by controlling at least one of the rotational speed of the rotational body and timing of forming the image on the rotational body, based on the correction parameter, a first board loaded with the storage, and a second board loaded with the adjusting unit, the second board being provided separately from the first board.

6 Claims, 8 Drawing Sheets

IMAGE FORMING DEVICE HAVING AN ADJUSTING UNIT FOR ADJUSTING AN IMAGE FORMING POSTION ON A ROTATIONAL BODY

CROSS-REFERENCE TO RELATED APPLICATIONS

This application claims priority under 35 U.S.C. §119 from Japanese Patent Application No. 2007-308568 filed on Nov. 29, 2007. The entire subject matter of the application is incorporated herein by reference.

BACKGROUND

1. Technical Field

The following description relates to one or more image forming devices configured to form an image by using a rotational body, more particularly, to one or more image forming devices configured to store a correction parameter for canceling a deviation of an image forming position caused due to unevenness of a rotational speed of the rotational body, and to correct the image forming position based on the correction parameter.

2. Related Art

An electrophotographic image forming device is configured to form an electrostatic latent image by optically scanning a surface of a rotating photoconductive body, and to transfer onto a recording sheet an image obtained by developing the electrostatic latent image with toner. According to such an image forming device, it is possible to form an image (including an electrostatic latent image) with a constant distance (scanning line interval) between any adjacent two of scanning lines by sequentially performing optical scanning at scanning timings of a constant time interval when the photoconductive drum rotates at a constant rotational speed. However, the photoconductive body is actually rotated at a periodically varying rotational speed. Therefore, unevenness of scanning line intervals might result in a low-quality image.

In view of the above problem, Japanese Patent Provisional Publication No. 2000-284561 discloses an image forming device configured to previously determine actual phases in a rotational movement of a photoconductive drum and a correction value at each of the phases, and to store on a memory the determined correction value as a correction parameter. The correction value denotes a correction value for scanning timing that is required for correcting a scanning line interval at each phase to be a standard line interval. When an image forming instruction is issued, the image forming device estimates a phase in the rotational movement of the photoconductive drum based on a phase of an original point of the photoconductive drum detected by an original point sensor and an internal clock provided in the image forming device. Then, the image forming device sequentially reads out a correction value corresponding to the estimated phase from the memory. Subsequently, based on the correction value as read out, the image forming device corrects the scanning timing for each scanning line, and corrects each scanning line interval to be the standard line interval.

SUMMARY

However, the aforementioned known image forming device has the following problems. Each aforementioned image forming device has individual different data regarding the rotational speed unevenness. Therefore, the correction parameter is determined for each image forming device on a manufacturing line, and stored on a non-volatile memory such as an EEPROM.

In this kind of image forming device, the non-volatile memory is mounted on a main board. However, in this case, when there is a trouble such as a failure with the non-volatile memory after shipment of the image forming device, the non-volatile memory is replaced along with the main board, and the correction parameter is re-determined using a specific apparatus. Further, when there is found some trouble with a portion of the main board other than the non-volatile memory, the main board is as well replaced. Namely, even though some trouble is caused in a portion of the main board other than the non-volatile memory, the non-volatile memory is forced to be replaced together. Then, as the non-volatile memory is replaced, the correction parameter has to be re-determined. It means serious fixing. In other words, in order to re-determine the correction parameter and store the re-determined parameter on a new non-volatile memory, the image forming device has to be retrieved, and then the correction parameter has to be obtained and stored. In addition, it might be forgotten to re-determine the correction parameter.

Aspects of the present invention are advantageous to provide one or more improved image forming devices that can easily be fixed when there is a trouble with a portion other than a non-volatile memory.

According to aspects of the present invention, an image forming device is provided, which includes a rotational body configured such that an image to be transferred onto a sheet is formed in an image forming position thereon, a storage configured to store thereon, in a non-volatile manner, a correction parameter for canceling a deviation of the image forming position caused due to unevenness of a rotational speed of the rotational body, an adjusting unit configured to adjust the image forming position by controlling at least one of the rotational speed of the rotational body and timing of forming the image on the rotational body, based on the correction parameter, a first board loaded with the storage, and a second board loaded with the adjusting unit, the second board being provided separately from the first board.

In some aspects of the present invention, the storage previously stores thereon the correction parameter for canceling a deviation of the image forming position caused due to unevenness of the rotational speed of the rotational body such as a photoconductive body. Then, the image forming position is adjusted by the adjusting unit based on the correction parameter, so as to prevent the quality of the image from being worsened.

Further, in some aspects of the present invention, the first board loaded with the storage such as an EEPROM that stores the correction parameter is provided separately from the second board loaded with the adjusting unit such as a CPU and an ASIC that adjusts the rotational speed of the rotational body or the timing of forming the image on the rotational body. Namely, the storage storing the correction parameter is separated from other parts that are more likely to be replaced. Therefore, when there is a problem with the second board of the adjusting unit, the second board is replaced while the first board is not replaced. Namely, as the storage is not replaced, it is needless to re-determine the correction parameter. Thus, since there is no effort required to retrieve the image forming device and re-determine the correction parameter, it is possible to avoid forgetting to re-determine the correction parameter.

BRIEF DESCRIPTION OF THE ACCOMPANYING DRAWINGS

Figure 4:
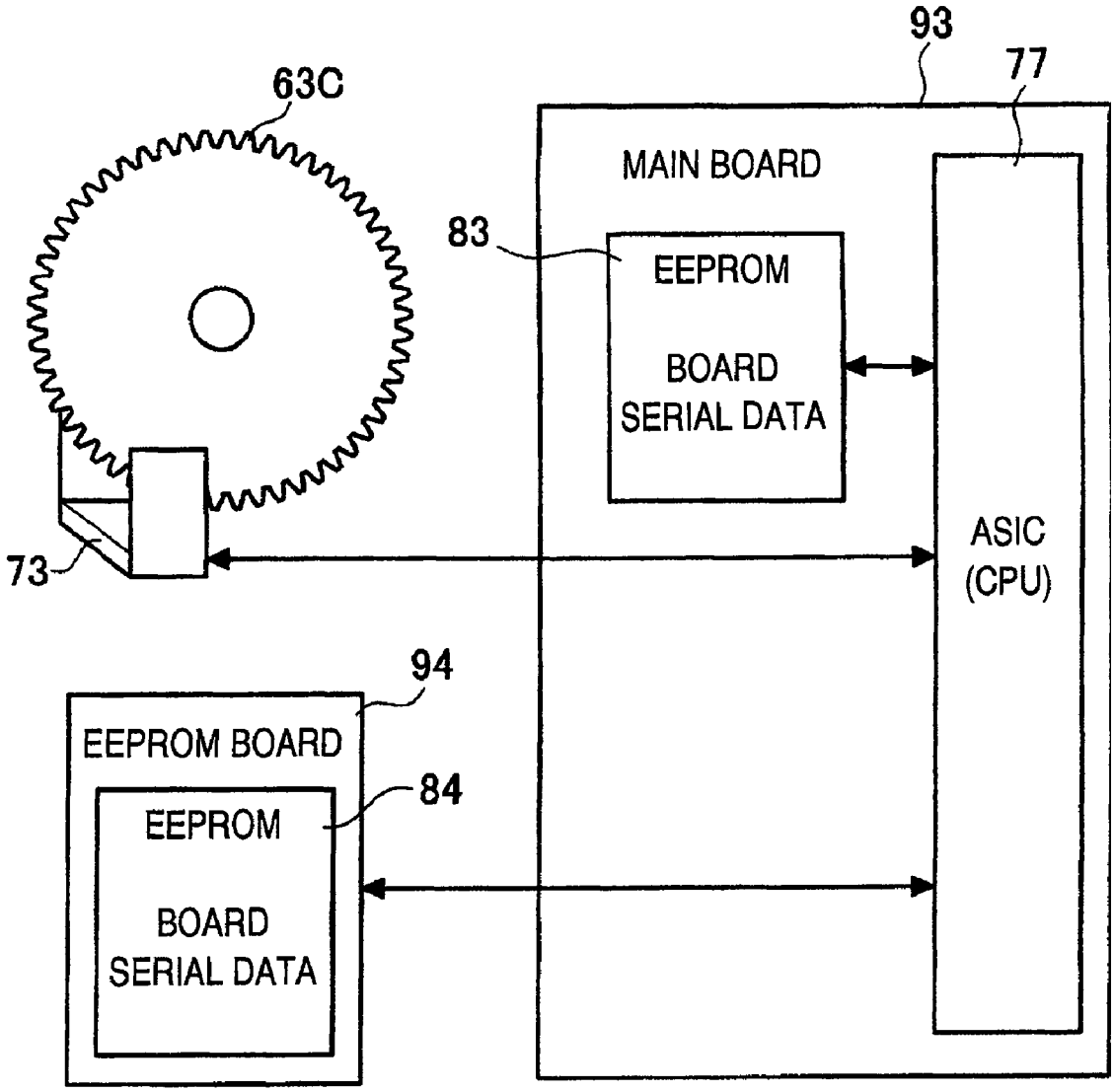

FIG. 4 schematically shows a relationship among a drive gear, an original point sensor, an EEPROM and a CPU mounted on a main board, and an EEPROM mounted on an EEPROM board in the embodiment according to one or more aspects of the present invention.

FIGS. 5A to 5D show phase dependences of rotational speeds of the drive gears and correction values in the embodiment according to one or more aspects of the present invention.

Figure 6:
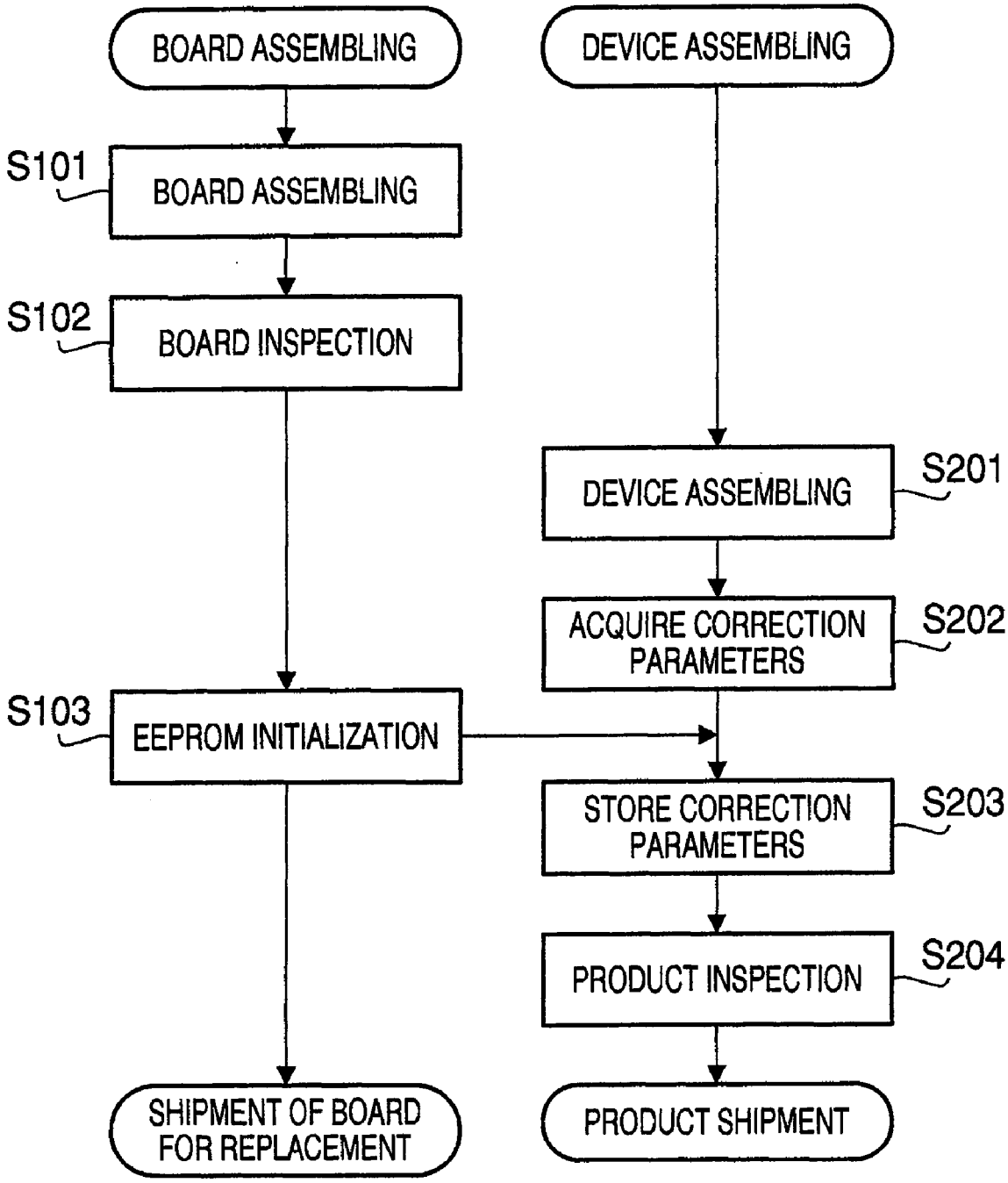

FIG. 6 is a flowchart showing a procedure up to factory shipment in the embodiment according to one or more aspects of the present invention.

Figure 7:
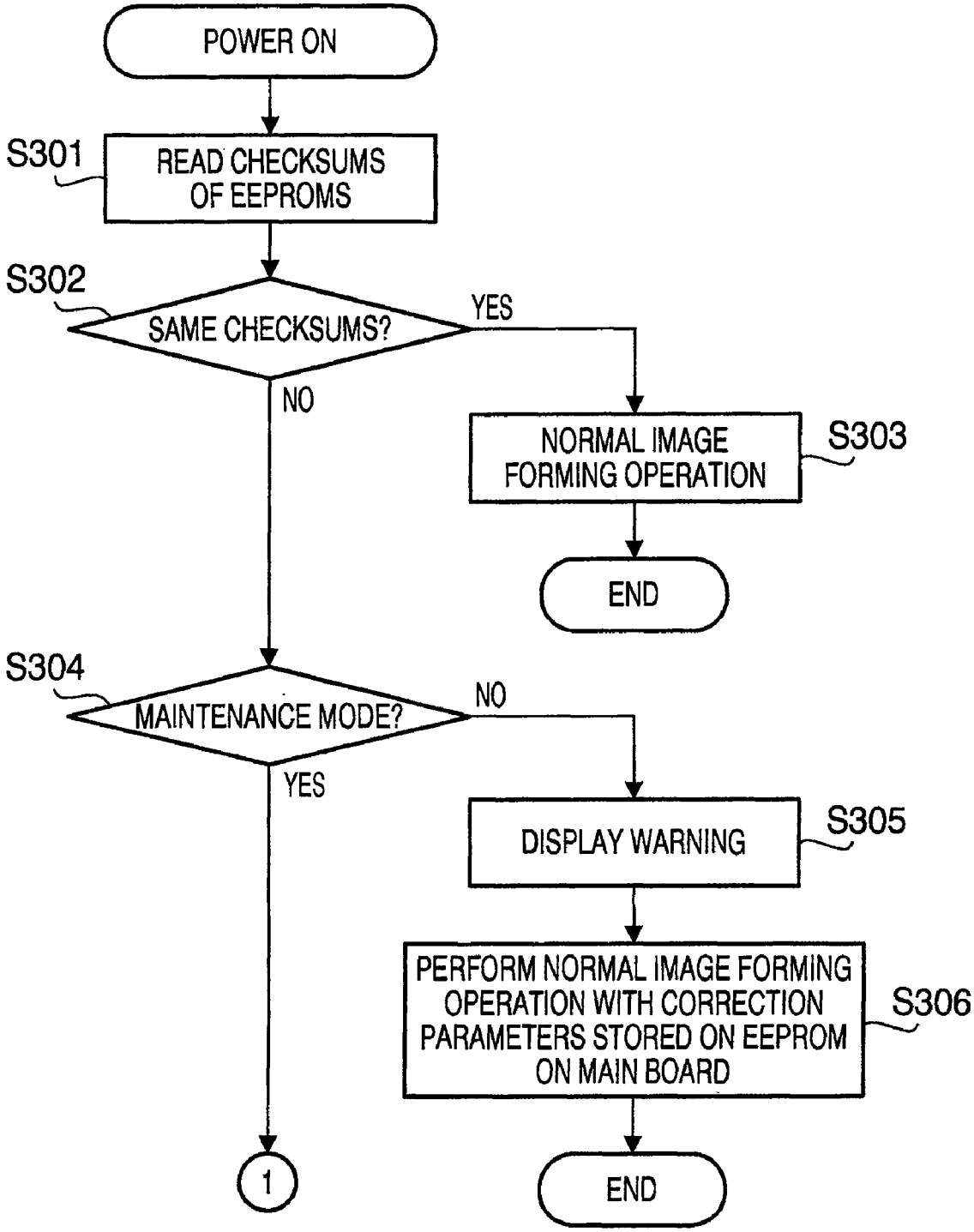

FIG. 7 is a flowchart showing a procedure of an inspecting operation for the EEPROMs in a user mode after the image forming device is powered ON in the embodiment according to one or more aspects of the present invention.

Figure 8:
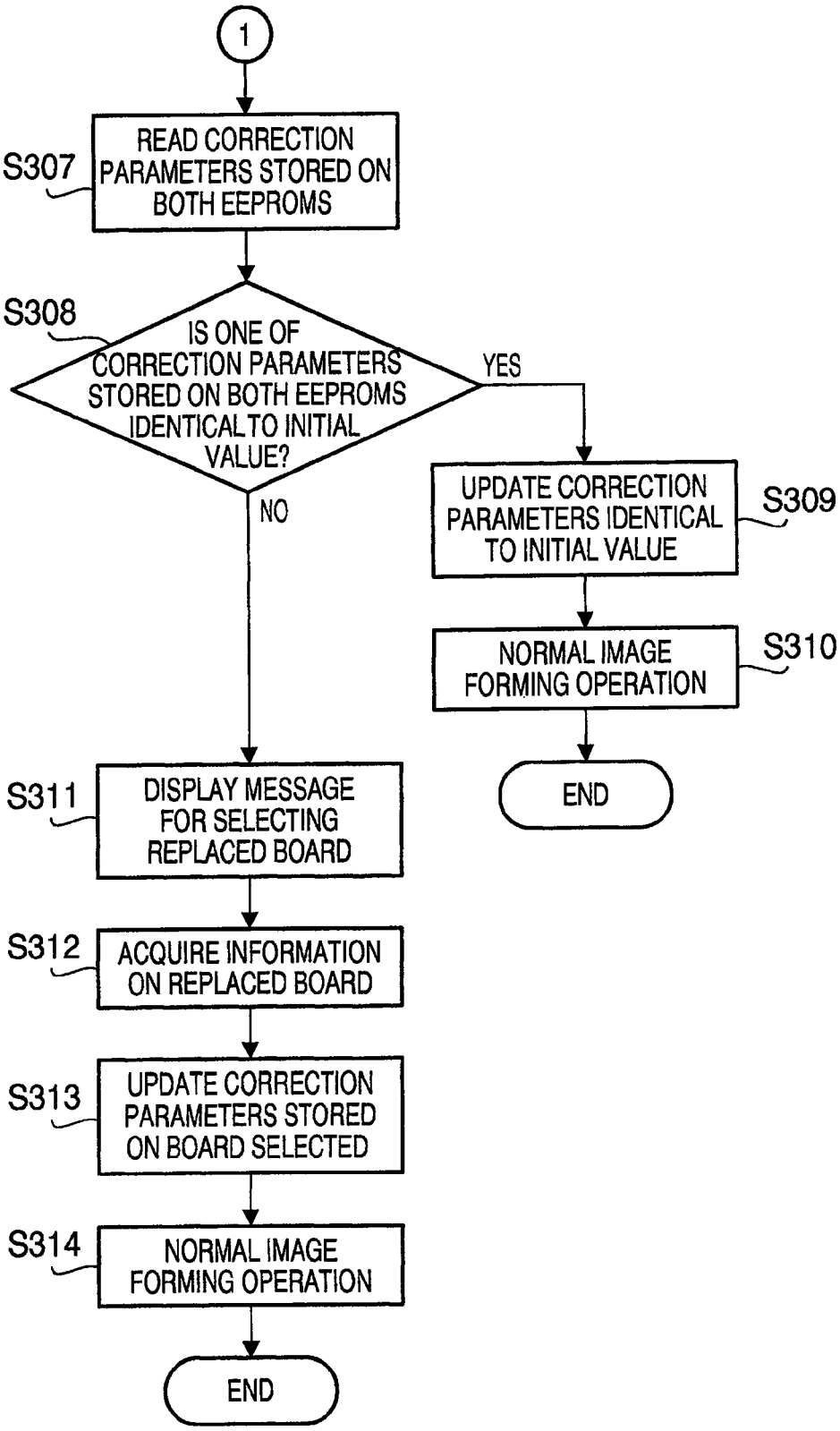

FIG. 8 is a flowchart showing a procedure of an inspecting operation for the EEPROMs in a maintenance mode after the image forming device is powered ON in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

Hereinafter, an embodiment according to aspects of the present invention will be described with reference to the accompany drawings. An image forming device of the embodiment is actualized by applying aspects of the present invention to an electrophotographic type color printer.

(Overall Configuration of Image Forming Device)

Figure 1:
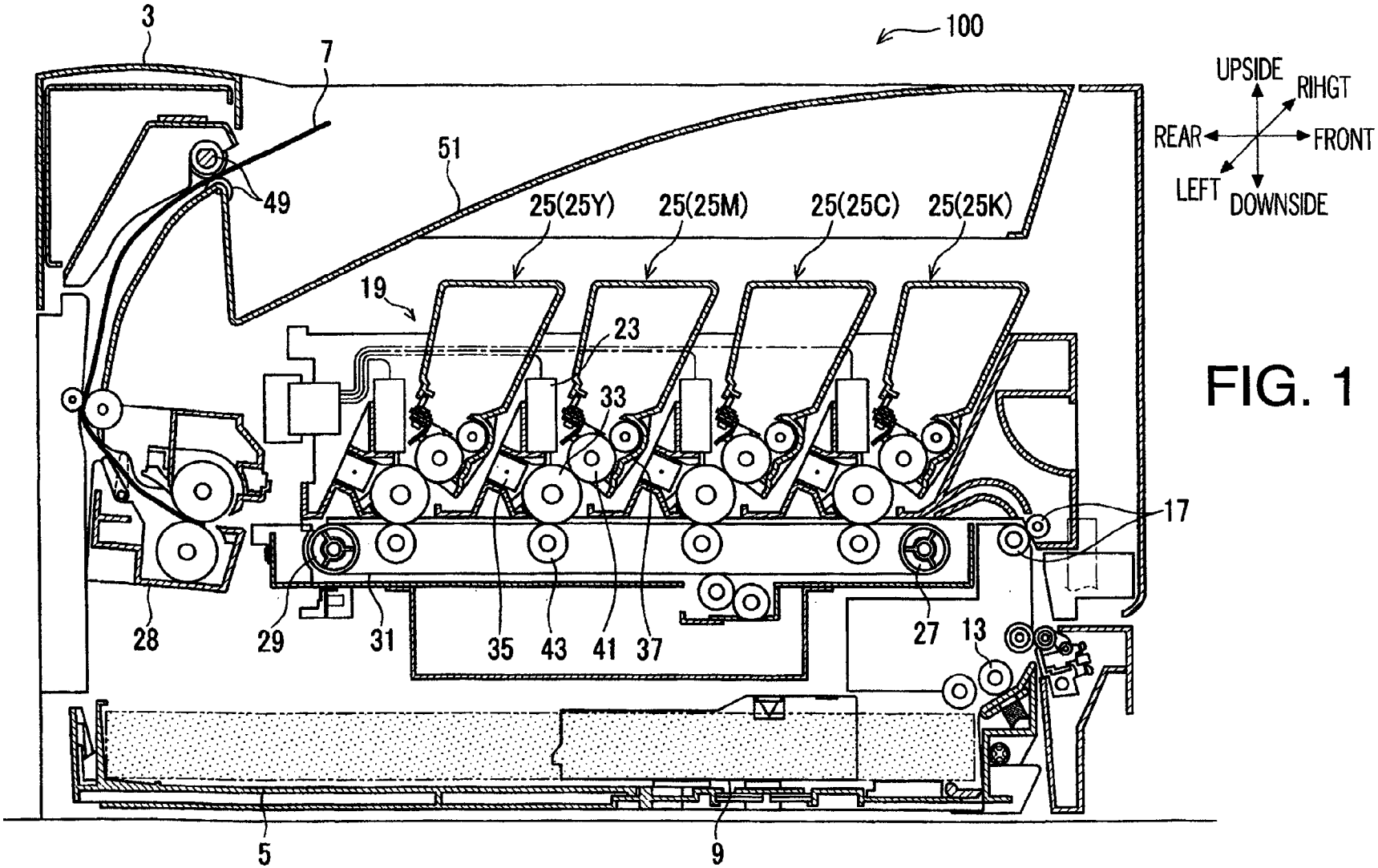
FIG. 1 is a cross-sectional side view schematically showing a configuration of an image forming device in an embodiment according to one or more aspects of the present invention.

An image forming device 100 of the present embodiment is a tandem color printer. As illustrated in FIG. 1, the image forming device includes a sheet feed tray 5 configured to feed a sheet 7 as a recording medium, an image forming unit 19 configured to form toner images of respective colors and sequentially transfer the toner images onto the sheet 7, a fixing unit 28 configured to fix to the sheet 7 the toner images transferred onto the sheet 7, a catch tray 51 configured to be loaded with the sheet 7 to which the toner images are fixed, and a case 3 serving as a housing.

The image forming unit 19 is provided with a belt 31 configured to carry the sheet 7, and four process units 25K, 25C, 25M, and 25Y corresponding to respective colors, namely, black, cyan, magenta, and yellow. In the following description, when elements or components have to be discriminated based on their corresponding colors, suffixes K (black), C (cyan), M (magenta), and Y (yellow) will be added to reference characters of the elements or components. Unless the elements or components have to be discriminated in such a way, the suffixes will be omitted.

The belt 31 is configured as an endless belt hung around a pair of supporting rollers 27 and 29. The belt 31 is revolved along with rotation of the supporting roller 29 as a driving roller, and carries the sheet 7 from registration rollers 17 to the fixing unit 28.

Each of the process units 25K, 25C, 25M, and 25Y is provided with a photoconductive body 33, a charger 35, an LED exposure unit 23, and a developing unit 37. The process units 25 have the same configuration except for their respective colors of toner.

The LED exposure unit 23 includes a plurality of light-emitting diodes (not shown) linearly aligned along an axial direction of the photoconductive body 33. In the LED exposure unit 23, the plurality of light-emitting diodes are on-off controlled based on image data for each color to scan a surface of the photoconductive body 33 with light.

In the process unit 25, the surface of the photoconductive body 33 is evenly charged by the charger 35. After that, the surface of the photoconductive body 33 is exposed with light emitted by the LED exposure unit 23, and an electrostatic latent image corresponding to an image to be formed on the sheet 7 is formed on the surface of the photoconductive body 33. Subsequently, via a developing roller 41 in the developing unit 37, the toner is supplied onto the photoconductive body 33. Thereby, the electrostatic latent image on the photoconductive body 33 is visualized as a toner image.

Meanwhile, the sheet 7 in the sheet feed tray 5 is pushed out by a pressing plate 9 toward a pickup roller 13, and fed to the registration rollers 17 by rotation of the pickup roller 13. Skew correction is implemented for the sheet 7 by the registration rollers, and the sheet 7 is carried onto the belt 31 at predetermined timing.

While the sheet 7, being conveyed by the belt 31, is passing through a transfer position between each of the photoconductive bodies 33 and a transfer roller 43, the toner image held on the surface of the photoconductive body 33 is transferred onto the sheet 7 by a transfer bias applied to the transfer roller 43. Thus, the toner images of the respective colors held on the photoconductive bodies 33 are sequentially transferred onto the sheet 7 and superimposed to form a color image. After that, the sheet 7 with the color image formed thereon is conveyed to the fixing unit 28.

The fixing unit 28 is configured to heat and press the sheet 7 with the toner image transferred thereon and thermally fix the toner image onto the sheet 7. Then, the sheet 7 fed out of the fixing unit 28 is discharged by sheet discharge rollers onto the catch tray 51.

[Configuration of Drive System of Image Forming Device]

Figure 2:
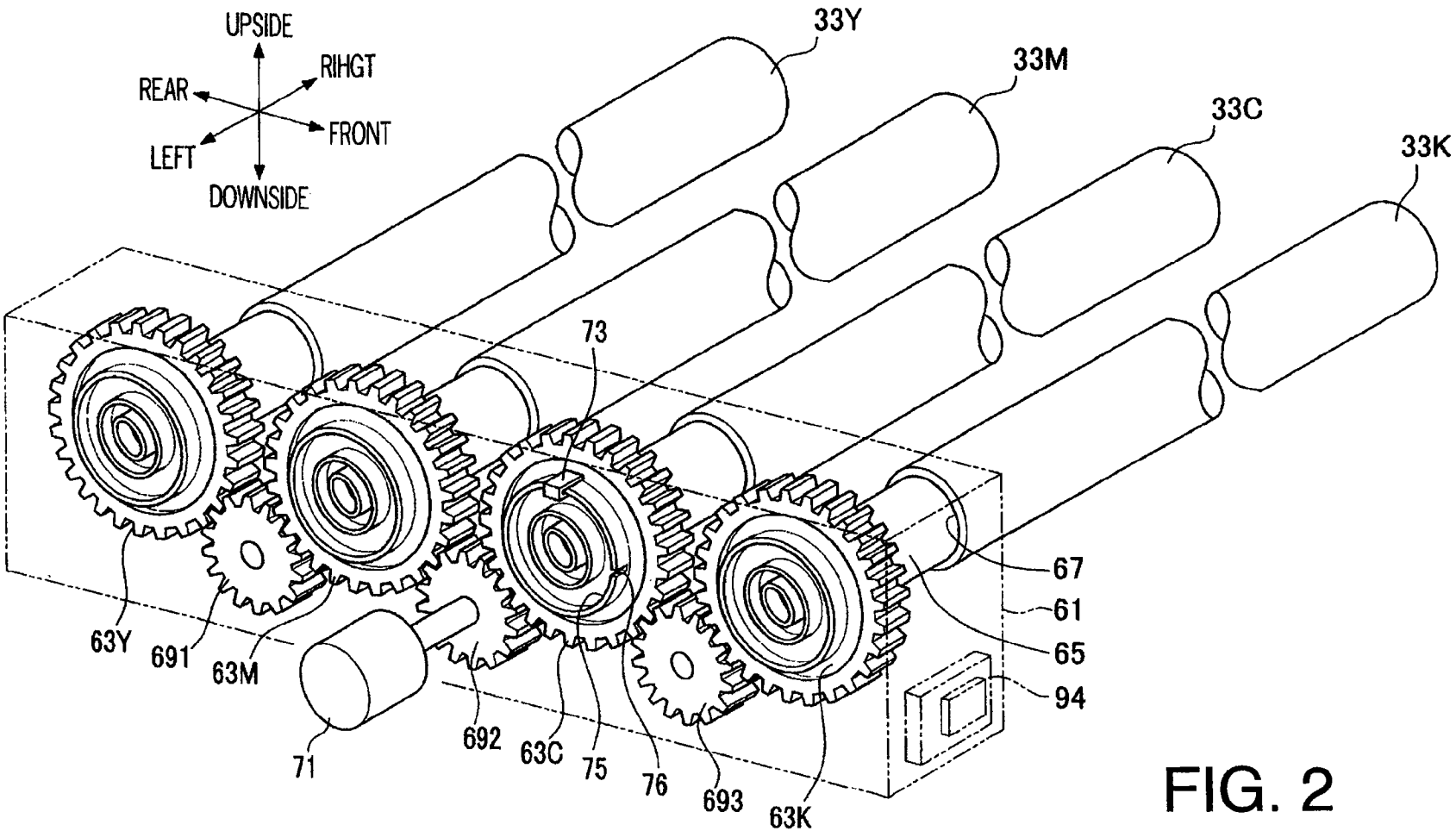
FIG. 2 is a perspective view schematically showing an internal structure of a drive unit of the image forming device in the embodiment according to one or more aspects of the present invention.

Subsequently, a drive unit configured to rotatably drive the photoconductive body 33 will be described. A drive unit 61 is, as illustrated in FIG. 2, disposed at an end in an axial direction of the four photoconductive bodies 33K, 33C, 33M, and 33Y.

The drive unit 61 has four drive gears 63K, 63C, 63M, and 63Y, which correspond to the photoconductive bodies 33K, 33C, 33M, and 33Y, respectively. Each of the drive gears 63 is provided to be rotatable coaxially with a corresponding photoconductive body 33. Further, each of the drive gears 63 is joined with a corresponding photoconductive body 33 via a coupling mechanism. Specifically, each drive gear 63 includes a fit portion 65 coaxially formed to protrude in an axial direction, and the fit portion 65 is fitted into a recess portion 67 formed at an end of the photoconductive body 33. Then, by a rotational driving force transmitted to each drive gear 63, the photoconductive bodies 33K, 33C, 33M, and 33Y are concurrently rotated. Any two of adjacent drive gears 63 are mutually coupled via an intermediate gear 691, 692, or 693. In the present embodiment, the centrally located intermediate gear 692 is given a driving force from a driving motor 71, and the four drive gears 63K, 63C, 63M, and 63Y and the four photoconductive bodies 33K, 33C, 33M, and 33Y are concurrently rotated.

In addition, one of the drive gears 63 (in the present embodiment, the drive gear 63C) is provided with an original point sensor 73. Further, the drive gear 63C includes a lib 75 formed annularly around a rotational axis of the drive gear 63C. In addition, the lib 75 has a slit 76 provided at a portion thereof. The original point sensor 73 is a transmission type optical sensor provided with a light emitting element and a light receiving element that mutually face via the lib 75. When a portion of the lib 75 other than the slit 76 is located at a detecting region of the original point sensor 73, light from the light emitting element is blocked. Therefore, the intensity of light received by the light receiving element is relatively low. Meanwhile, when the slit 76 is located at the detecting region, namely, when a phase of the drive gear 63C reaches a phase of the original point, the light from the light emitting element is not blocked. In this case, the intensity of the light received by the light receiving element is higher than the above situation. The original point sensor 73 transmits a detection signal varying depending on the intensity of the received light to a below-mentioned CPU 77.

[Electrical Configuration of Image Forming Device]

Figure 3:
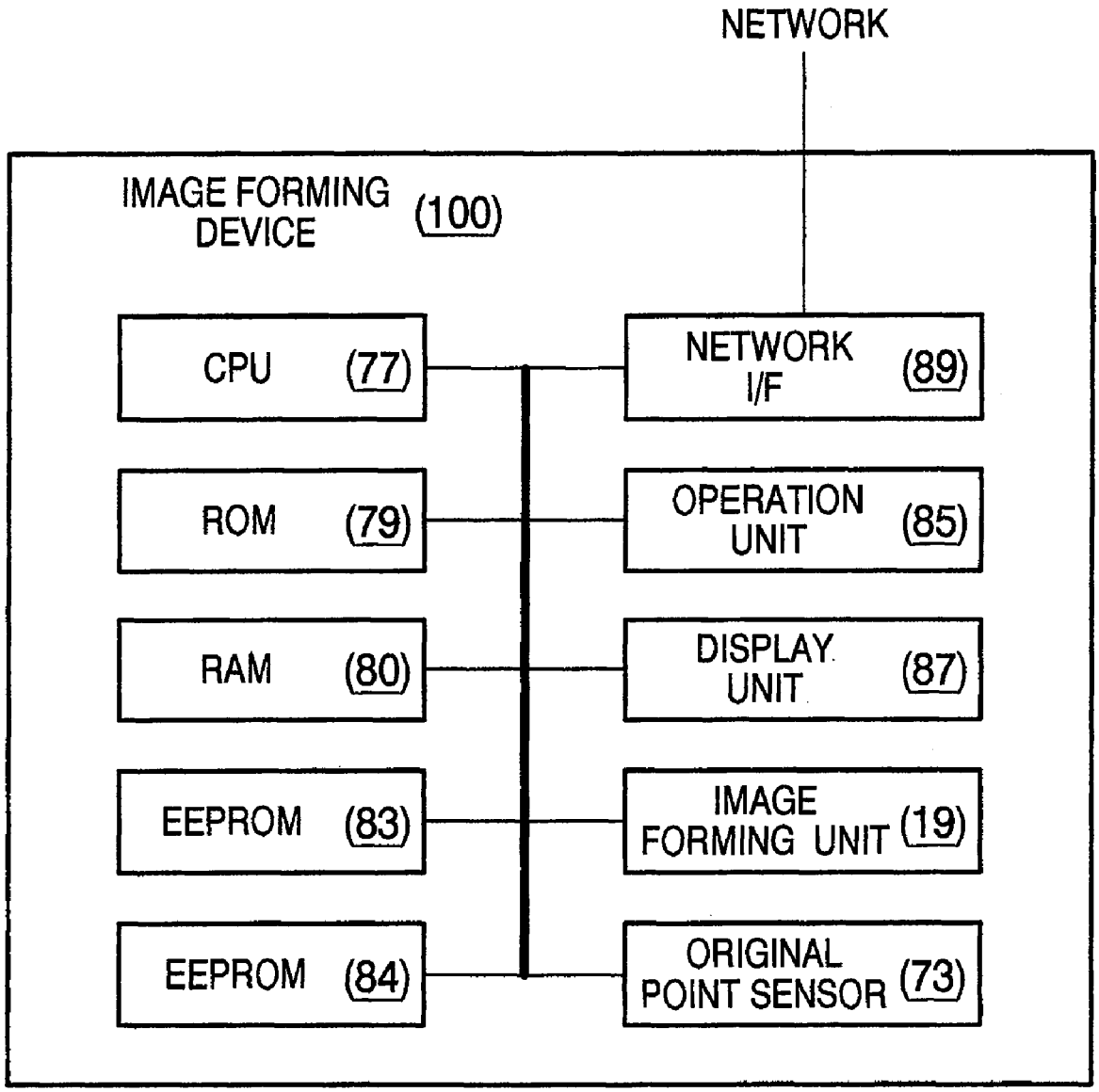
FIG. 3 is a block diagram schematically showing an electrical configuration of the image forming device in the embodiment according to one or more aspects of the present invention.

Next, explanation of an electrical configuration of the image forming device 100 will be given. As shown in FIG. 3, the image forming device 100 includes a CPU 77, a ROM 79, a RAM 81, an EEPROM 83, an EEPROM 84, an operation unit 85, a display unit 87, a network interface 89, the aforementioned image forming unit 19, the aforementioned original point sensor 73.

The ROM 79 stores thereon various control programs, various settings, and various initial values. The RAM 81 is employed as a work area into which various control programs can be read out or as a memory area in which image data is temporarily stored. The CPU 77 is adopted to control operations of the image forming device 100 while storing processing results onto the RAM 81, in accordance with programs read out from the ROM 79. For example, the CPU 77 adjusts image forming timing based on the correction parameter and corrects an image forming position so as to prevent image quality from being worsened.

The EEPROM 83 and EEPROM 84 store thereon respective correction parameters for the photoconductive bodies 33. It is noted that each correction parameter stored on the EEPROM 83 is identical to each correction parameter stored on the EEPROM 84. The correction parameters will be described in detail later.

Further, the EEPROM 83 and EEPROM 84 are disposed on respective different boards. In the present embodiment, as illustrated in FIG. 4, the EEPROM 83 is placed on a main board 93 configured to be loaded with the CPU 77, while the EEPROM 84 is placed on an EEPROM board 94 dedicated to the EEPROM 84.

In addition, the EEPROM board 94 is, as shown in FIG. 2, is attached to and integrated with the drive unit 61. The correction parameters are based on actual measurement values determined individually for the drive unit 61. The present embodiment is adopted to avoid mismatch between the EEPROM 84 and the drive gear 63 by integrating the EEPROM 84 and the drive gear 63.

The operation unit 85 includes buttons and switches, through which various input operations such as user instruction to start printing are performed. The display unit 87 includes a liquid crystal display or lamps, and displays various setting screens and operational statuses. Further, the display unit 87 is adopted to display a warning notifying of some sort of abnormal event caused in the image forming device 100, when the abnormal event is detected by the CPU 77. The network interface 89 is connected with an external information processing device via a network to make possible bidirectional data communication.

[Correction Parameter]

The correction parameters are employed to modify, to a predetermined interval as a design value, intervals of the scanning lines in an auxiliary scanning direction (hereinafter referred to as "scanning line intervals") that varies depending on unevenness of the rotational speeds of the photoconductive bodies 33 (the drive gears 63).

Figure 5A:
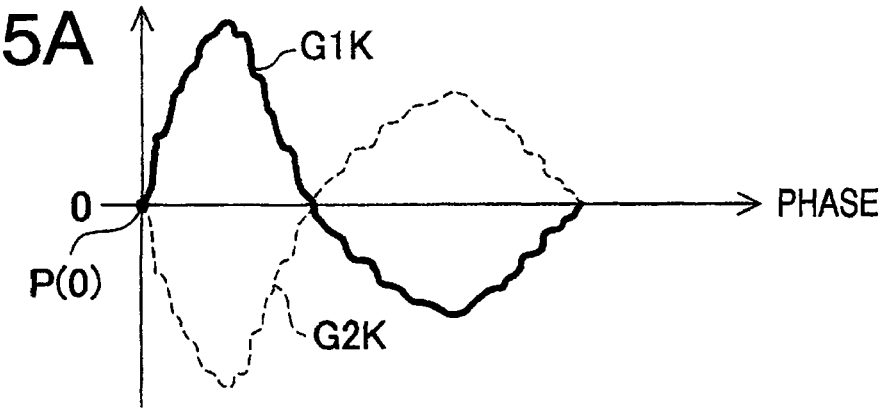
Figure 5B:
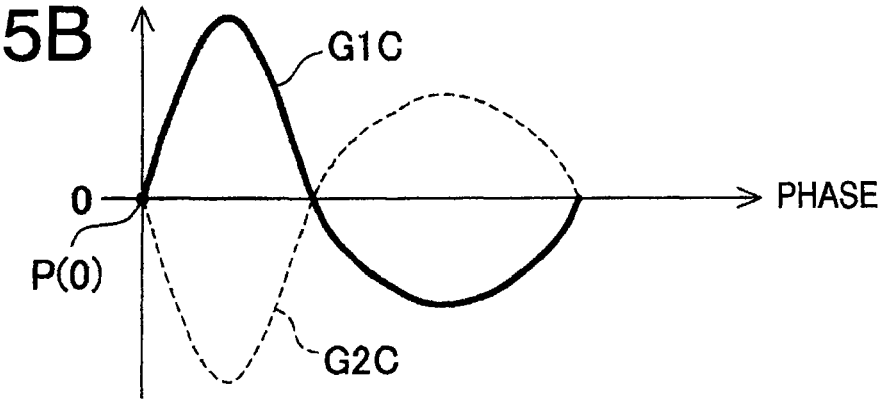
Figure 5C:
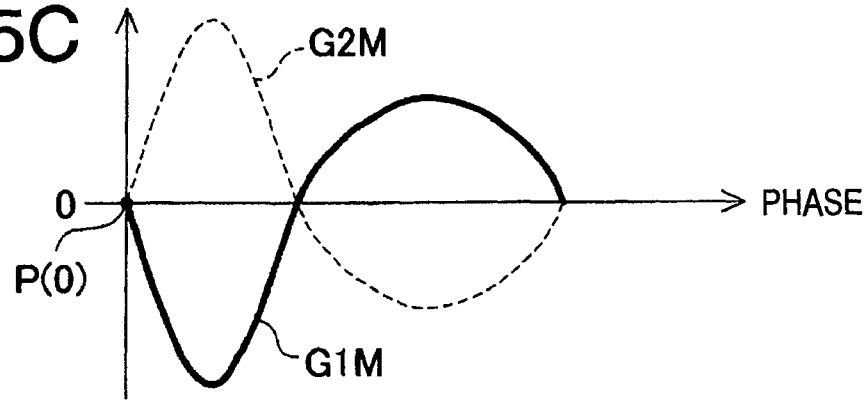
Figure 5D:
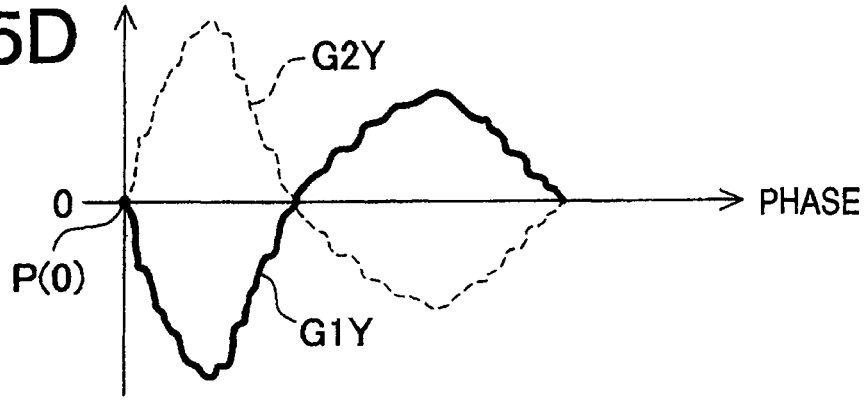

FIGS. 5A to SD show fluctuations of the rotational speeds during one cycle of the drive gears 63K, 63C, 63M, and 63Y Solid lines G1K, G1C, G1M, and G1Y shown in FIGS. 5A to 5D are based on actual measurement values of the rotational speeds of the drive gears 63K, 63C, 63M, and 63Y, respectively. Specifically, the solid lines G1K, G1C, G1M, and G1Y represent differences between the actual measurement values (actual rotational speeds) and a predetermined speed. In addition, dashed lines G2K, G2C, G2M, and G2Y shown in FIGS. 5A to 5D denote phase dependences of correction values that vary as the corresponding solid lines G1K, G1C, G1M, and G1Y are inverted with respect to respective phase axes.

In FIGS. 5A to 5D, for example, when a solid line G1 is above a zero line (the phase axis), it means the actual rotational speed of the drive gear 63 is higher than the predetermined speed. In other words, it means that the scanning line interval becomes wider than the predetermined interval. Meanwhile, when a solid line G1 is under the zero line, it means that the actual rotational speed is higher than the predetermined speed. That is, it means that the scanning line interval becomes narrower than the predetermined interval.

While a dashed line G2 is under the zero line, the scanning line intervals are adjusted to be identical to the predetermined interval by shortening time intervals for the scanning timing of the LED exposure unit 23 by the correction values. On the other hand, while a dashed line G2 is above the zero line, the scanning line intervals are adjusted to be identical to the predetermined interval by elongating the time intervals for the scanning timing of the LED exposure unit 23 by the correction values.

Then, based on the dashed lines G2, a correspondence relationship between a phase P (N) (N: 0~M) of each gear 63 and a correction difference ΔD (N) (N: 0~M) is determined. In the present embodiment, a table of a correspondence relationship between an address N (N: 0~M) corresponding to the phase P (N) (N: 0~M) and the correction difference ΔD (N) (N: 0~M) is stored, as a correction parameter, on the EEPROM 83 and 84.

[Flow up to Factory Shipment]

Subsequently, a flow up to shipment of the image forming device 100 will be described with reference to a flowchart shown in FIG. 6.

First, prior to assembling the image forming device 100, assembling of parts onto the main board 93 and the EEPROM board 94 is implemented (S101). Namely, each electronic component such as the EEPROM 83 and the EEPROM 84 is mounted onto a corresponding one of the main board 93 and the EEPROM board 94. After the assembling, a condition in which each electronic component is mounted is checked (S102).

Next, the EEPROM 83 and the EEPROM 84 mounted on the respective boards checked are initialized (S103). Namely, predetermined default values are written onto the EEPROM 83 and the EEPROM 84 under new conditions, respectively. In the present embodiment, the EEPROM 83 and the EEPROM 84 are initialized such that all stored thereon becomes "FFh." Each board on which the EEPROM 83 or 84 is initialized is shipped as a board for a product or a replacement for a broken EEPROM.

Subsequently, each unit such as the drive unit 61 included in the image forming device 100 is assembled to the image forming device 100 (S201). After that, the correction parameters are acquired while the drive unit 61 is being operated (S202). Specifically, a jig for measurement is attached to an end opposite the drive unit 61 in the axial direction of the photoconductive bodies 33K, 33C, 33M, and 33Y. Then, the rotational speeds of the photoconductive bodies 33K, 33C, 33M, and 33Y are measured After that, by calculating differences between the measurement values and the predetermined speed, the correction parameters are determined. The correction parameters are determined for each image forming device 100 (drive unit 61).

Next, the correction parameters acquired are written onto each of the EEPROM 83 on the main board 93 and the EEPROM 84 on the EEPROM board 94 of the image forming device 100 as a measured subject (S203). Thereby, the correction parameters stored on the EEPROM 83 are identical to the correction parameters stored on the EEPROM 84. After that, a final inspection for a product is implemented (S204). Thus, image forming devices 100 confirmed to normally function through the final inspection are shipped as a product.

[Flow after Power-On]

Subsequently, an inspection operation for the EEPROM 83 and the EEPROM 84 to be executed after the image forming device 100 is powered ON will be explained with reference to FIGS. 7 and 8. FIG. 7 is a flowchart showing a procedure of an operation in a normal mode (a user mode) in which a user utilizes the image forming device 100. FIG. 8 is a flowchart showing a procedure of an operation in a maintenance mode in which, for example, a service person fixes the image forming device 100.

After the image forming device 100 is powered ON, as illustrated in FIG. 7, the CPU 77 first obtains a checksum of data on the EEPROM 84 on the EEPROM board 94 and a checksum of data on the EEPROM 83 on the main board 93 (S301). Then, the CPU 77 determines whether the checksums obtained are the same (S302).

When the checksums are the same (S302: Yes), it is presumed that the correction parameters stored on the EEPROM 83 and the EEPROM 84 are the same as the predetermined default values before shipment, namely, that replacement of the board 93 or 94 is not performed, or the EEPROM 83 or 84 is not broken. Therefore, a normal image forming operation is performed (S303). In the normal image forming operation, a process for correcting the scanning timing of the LED exposure unit 23 is performed. In the correcting process, the correction parameters stored on the EEPROM 83 on the main board 93 are employed. Thus, by using the correction parameters stored on the EEPROM 83 on the main board 93 as the same board as the CPU 77 is mounted in preference to the correction parameters stored on the EEPROM 84 on the EEPROM board 94, improvement of a processing speed can be expected.

When the checksums are not the same (S302: No), it is presumed that there is abnormality of at least one of the EEPROM 83 and the EEPROM 84 or that one of the main board 93 and the EEPROM board 94 has been replaced. This is because immediately after one of the main board 93 and the EEPROM board 94 has been replaced, a checksum of an EEPROM on a replaced board is not identical to a checksum of an EEPROM on the other non-replaced board.

Subsequently, it is determined whether the image forming device 100 in the maintenance mode (S304). When the image forming device 100 is not in the maintenance mode (S304: No), a warning (message) that at least one of the boards 93 and 94 may be broken is displayed on the liquid crystal display of the display unit 87 (S305). Thereby, the user can recognize that something is wrong with the image forming device 100 and it is required to be fixed. It is noted that the warning may be issued, for example, by putting on an error lamp, making a warning sound, or transmitting data to another information device, as well as displaying the message on the display unit 87.

After the warning is displayed in S305, a normal image forming operation is performed by employing the correction parameters stored on one of the EEPROMs 83 and 84 that is determined to have higher reliability against a failure based on locations of the EEPROMs 83 and 84 (S306). In the present embodiment, the image forming operation is performed using the correction parameters stored on the EEPROM 83 on the main board 93.

Meanwhile, when the image forming device 100 is in the maintenance mode (S304: Yes), as shown in FIG. 8, the correction parameters stored on the EEPROM 83 and the correction parameters stored on the EEPROM 84 are read (S307). Then, it is determined whether one of the correction parameters stored on the EEPROM 83 and the correction parameters stored on the EEPROM 84 is identical to the initial value (in the present embodiment, FFh) (S308). Namely, it is determined in S308 whether one of the boards 93 and 94 is a new one.

When one of the correction parameters stored on the EEPROM 83 and the correction parameters stored on the EEPROM 84 is identical to the initial value (S308: Yes), it is presumed that one of the boards 93 and 94 has been replaced. Then, the stored data is copied from an EEPROM on which the correction parameters are not identical to the initial value to the other EEPROM on which the correction parameters are identical to the initial value (S309). Thereby, the correction parameters stored on an EEPROM on a new board are updated with the correction parameters stored on the EEPROM on the other non-replaced board. In other words, without having to again acquire actual measurement values for the drive unit 61, both the correction parameters on the EEPROM 83 and the correction parameters on the EEPROM 84 are set to the condition at the time of shipment. After that, a normal image forming operation is performed (S310).

Meanwhile, when one of the correction parameters stored on the EEPROM 83 and the correction parameters stored on the EEPROM 84 is not identical to the initial value (S308: No), it is presumed that one of the boards 93 and 94 has been replaced with a board which is not new (for example, a recycled board once used). Then, a message for inducing the service person to select which board has been replaced is displayed on the liquid crystal display of the display unit 87 (S311). Then, when the service person inputs a selection of which board has been replaced, information representing which board has been replaced is acquired (S312).

Thereafter, the stored data is copied from an EEPROM on an unselected board to the EEPROM on the other board selected (S313). Namely, the correction parameters stored on a replaced board are updated with the correction parameters stored on the other non-replaced board. Thereby, even though a board other than a new one is replaced, without having to again acquire actual measurement values for the drive unit 61, both the correction parameters on the EEPROM 83 and the correction parameters on the EEPROM 84 are set to the condition at the time of shipment. After that, a normal image forming operation is performed (S314).

As described above, the image forming device 100 of the present embodiment is provided with the EEPROM board 94 loaded with the EEPROM 84 that stores the correction parameters separately from the main board 93 loaded with the CPU 77 that adjusts the image forming timing. Namely, the EEPROM 84 that stores the correction parameters is separated from the main board 93 that is highly likely to be replaced. Therefore, when there is a trouble with the main board 93, the main board 93 is replaced, but the EEPROM board 94 is not replaced. Hence, the correction parameters can be acquired at least from the EEPROM 84, and do not have to be re-determined. It results in no effort required to retrieve the image forming device 100 and re-determine the correction parameters, and thereby in easy repair. Further, since the correction parameters do not have to be re-determined, it is possible to avoid forgetting to re-determine the correction parameters. Thus, it is possible to attain an image forming device that can easily be fixed when there is a trouble with a portion other than a non-volatile memory.

Further, the image forming device 100 of the present embodiment has the EEPROM 83, provided on the main board 93 as well, which stores the correction parameters identical to those stored on the EEPROM 84. Additionally, even though one of the EEPROMs 83 and 84 is replaced, the correction parameters are acquired from the other EEPROM, and data stored on the replaced EEPROM is automatically updated with the correction parameters acquired. Thereby, even though the EEPROM board 94 is replaced, the correction parameters do not have to be re-determined.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

For example, the image forming device according to aspects of the present invention may be any device configured to form an image such as a printer, a copy machine, a scanner, and a facsimile machine. In addition, the image forming method of the image forming unit is not limited to the electrophotographic method, and may be an inkjet method. Further, the image forming device may be adopted to be capable of color image forming or to be dedicated to monochrome image forming.

Further, in the aforementioned embodiment, a single drive motor drives four photoconductive bodies. However, a drive motor may be provided for each photoconductive body. In addition, a color image forming method may be a four-cycle method as well as the tandem method.

Further, in the aforementioned embodiment, a photoconductive body is specified as a rotational body that is a correction target. However, for example, a belt configured to carry a sheet thereon may be specified as a correction target. Additionally, when a transfer belt is provided such that a toner image is transferred thereto, the transfer belt may be specified as a correction target.

Further, a board loaded with the EEPROM 84 may not necessarily be a board dedicated to the EEPROM 84. Namely, any board different from the main board likely to be frequently replaced may be acceptable as a board loaded with the EEPROM 84. In addition, a board loaded that has few parts thereon and is less likely to be replaced is desirable as a board loaded with the EEPROM 84.

Further, in the aforementioned embodiment, "FFh" is written for the correction parameters so as to initialize the EEPROMs. However, what is written for the correction parameters may be a predetermined value such as "00h."

Further, in the aforementioned embodiment, by comparing the checksums of the data stored on both the EEPROMs, it is detected whether one of the boards has been replaced. However, for example, a common serial number is prepared for the main board and the EEPROM board, and the serial number is stored onto both the EEPROM on the main board and the EEPROM on the EEPROM board at the time of shipment. Then, when the image forming device is powered ON, by comparing the serial numbers stored on both the EEPROMs, it is detected whether one of the boards has been replaced.

Further, in the aforementioned embodiment, by adjusting the scanning timing of the LED exposure unit 23 based on the correction parameter therefor, the image forming position on the photoconductive body 33 is corrected. However, for example, in order to correct the image forming position, the rotational speed of the photoconductive body 33 may be adjusted based on the correction parameter. Namely, the rotational speed of the drive motor 71 driving the photoconductive body 33 may be controlled to diminish unevenness of the rotational speed of the photoconductive body 33.

What is claimed is:

1. An image forming device, comprising:

a rotational body configured to receive a formation, in an image forming position, of an image to be transferred onto a sheet;

an adjusting unit configured to adjust the image forming position by controlling at least one of a rotational speed of the rotational body and timing of forming the image on the rotational body, based on a correction parameter for canceling a deviation of the image forming position caused by unevenness in the rotational speed of the rotational body, a first storage configured to store thereon, in a non-volatile manner, a first correction parameter;

a first board loaded with the first storage; and a second board loaded with the adjusting unit, the second board being provided separately from the first board;

a second storage mounted on the second board and configured to store thereon a second correction parameter; and a determining unit configured to determine whether the first correction parameter stored on the first storage mounted on the first board is identical to the second correction parameter stored on the second storage mounted on the second board, wherein the adjusting unit is configured to adjust the image forming position based on the second correction parameter stored on the second storage upon the determining unit determining that the first correction parameter stored on the first storage mounted on the first board is identical to the second correction parameter stored on the second storage mounted on the second board.

2. The image forming device according to claim 1, further comprising a warning unit configured to, upon the determining unit determines that the first correction parameter is not identical to the second correction parameter, warn that the first correction parameter is not identical to the second correction parameter.

3. The image forming device according to claim 1, further comprising:

a second determining unit configured to determine whether the first correction parameter is appropriate and to determine whether the second correction parameter is appropriate; and an updating unit configured to update one of the first correction parameter and the second correction parameter determined to not be appropriate with the other one of the first correction parameter and the second correction parameter determined to be appropriate.

4. The image forming device according to claim 3, further comprising a selecting unit configured to select, as a correction parameter to be updated, one of the first correction parameter stored on the first storage and the second correction parameter stored on the second storage.

5. The image forming device according to claim 1, further comprising a drive unit configured to drive the rotating body, the drive unit being provided integrally with the first board having the first storage mounted thereon.

6. An apparatus comprising:

a rotational body configured to receive a formation of an image in an image formation position;

at least one processor; and memory storing computer readable instructions that, when executed by the at least one processor, cause the apparatus to:

store, on a first storage unit mounted on a first board, a first correction parameter for canceling a deviation of the image forming position caused by unevenness in rotational speed of the rotational body;

determine whether the first correction parameter stored on the first storage unit is identical to a second correction parameter stored on a second storage unit mounted on a second board separate from the first board, wherein the at least one processor is loaded on the second board; and adjust the image forming position based on the second correction parameter stored on the second storage unit upon determining that the first correction parameter stored on the first storage unit mounted on the first board is identical to the second correction parameter stored on the second storage mounted on the second board.

* * * * *